US012397984B2

(12) United States Patent
Angeloni et al.

(10) Patent No.: US 12,397,984 B2
(45) Date of Patent: Aug. 26, 2025

(54) CLAMSHELL PACKAGING CONTAINER

(71) Applicant: Wm. Wrigley Jr. Company, Chicago, IL (US)

(72) Inventors: Paul J. Angeloni, Chicago, IL (US); Ross E. Bartels, Chicago, IL (US); William Tham, Chicago, IL (US); H. Stephen Quinn, Chicago, IL (US); Christopher H. Cunningham, Chicago, IL (US)

(73) Assignee: Wm. Wrigley Jr. Company, Chicago, IL (US)

( * ) Notice: Subject to any disclaimer, the term of this patent is extended or adjusted under 35 U.S.C. 154(b) by 0 days.

(21) Appl. No.: 18/258,935

(22) PCT Filed: Dec. 21, 2021

(86) PCT No.: PCT/US2021/064676

§ 371 (c)(1),
(2) Date: Jun. 22, 2023

(87) PCT Pub. No.: WO2022/146794

PCT Pub. Date: Jul. 7, 2022

(65) Prior Publication Data

US 2024/0043199 A1 Feb. 8, 2024

Related U.S. Application Data

(60) Provisional application No. 63/132,111, filed on Dec. 30, 2020.

(51) Int. Cl.

| | |
|---|---|
| ***B65D 43/16*** | (2006.01) |
| ***B65D 75/24*** | (2006.01) |
| ***B65D 85/60*** | (2006.01) |

(52) U.S. Cl.
CPC ..... *B65D 85/60* (2013.01); *B65D 43/162* (2013.01); *B65D 75/245* (2013.01)

(58) Field of Classification Search
CPC ... B65D 75/245; B65D 43/164; B65D 43/162
(Continued)

(56) References Cited

U.S. PATENT DOCUMENTS

| | | | |
|---|---|---|---|
| 4,225,038 | A | 9/1980 | Egly |
| 4,289,235 | A | 9/1981 | Egly |

(Continued)

FOREIGN PATENT DOCUMENTS

| | | | |
|---|---|---|---|
| GB | 2304331 | A | 3/1997 |
| JP | H11245931 | A | 9/1999 |
| KR | 20140057444 | A | 5/2014 |

OTHER PUBLICATIONS

Angeloni, Extra Brand, RMS, Jul. 15, 2022, ., ., https://www.paulangeloni.com/the-finance-pulse, US.

*Primary Examiner* — Anthony D Stashick
*Assistant Examiner* — Raven Collins
(74) *Attorney, Agent, or Firm* — Bookoff McAndrews, PLLC

(57) ABSTRACT

Clamshell packaging containers and methods of making them are disclosed. A container includes a first shell portion and a complementary second shell portion that defines a product cavity. A bridging portion coupled to the first shell portion at a first hinge and the second shell portion at a second hinge such that the bridging portion is pivotable relative to each of the first shell portion at the first hinge and the second shell portion at the second hinge in a disassembled configuration, and is pivotable relative to one of the first shell portion at the first hinge and the second shell portion at the second hinge in an assembled configuration.

20 Claims, 5 Drawing Sheets

(58) Field of Classification Search
USPC ..... 206/425, 45.18, 387, 4.22
See application file for complete search history.

(56) References Cited

U.S. PATENT DOCUMENTS

| | | | | |
|---|---|---|---|---|
| 4,369,879 | A * | 1/1983 | Egly | G11B 33/0433 206/472 |
| D277,418 | S | 1/1985 | Bluestein et al. | |
| 4,527,692 | A | 7/1985 | Neuman | |
| 4,684,019 | A | 8/1987 | Egly | |
| D322,687 | S | 12/1991 | Tschudin | |
| 5,154,287 | A * | 10/1992 | Morita | G11B 23/0236 206/387.1 |
| D345,304 | S | 3/1994 | Leader | |
| 6,457,580 | B1 | 10/2002 | Focke et al. | |
| D516,422 | S | 3/2006 | Willson et al. | |
| D566,397 | S | 4/2008 | Jones | |
| D611,806 | S | 3/2010 | Bried | |
| D671,677 | S | 11/2012 | Wu | |
| 8,672,196 | B2 | 3/2014 | Pourian et al. | |
| D729,056 | S | 5/2015 | She et al. | |
| D729,057 | S | 5/2015 | She et al. | |
| D748,467 | S | 2/2016 | Angeloni et al. | |
| D753,960 | S | 4/2016 | Hart et al. | |
| D756,768 | S | 5/2016 | Cunningham | |
| D762,466 | S | 8/2016 | Angeloni et al. | |
| D808,791 | S | 1/2018 | Johnston et al. | |
| D808,793 | S | 1/2018 | Angeloni et al. | |
| D819,440 | S | 6/2018 | Cunningham et al. | |
| D842,983 | S | 3/2019 | Eitzman et al. | |
| D849,245 | S | 5/2019 | Eitzman et al. | |
| D861,370 | S | 10/2019 | Cunningham et al. | |
| D882,758 | S | 4/2020 | Eitzman et al. | |
| D900,306 | S | 10/2020 | Eitzman et al. | |
| D904,023 | S | 12/2020 | Wang | |
| D907,049 | S | 1/2021 | Yu | |
| 2005/0189252 | A1 * | 9/2005 | Naylor | A61B 50/36 206/439 |
| 2005/0252809 | A1 | 11/2005 | Aldridge et al. | |
| 2010/0160852 | A1 | 6/2010 | Moore, Jr. | |
| 2011/0303574 | A1 | 12/2011 | Aldridge et al. | |
| 2013/0327820 | A1 | 12/2013 | Clark et al. | |

* cited by examiner

CLAMSHELL PACKAGING CONTAINER

TECHNICAL FIELD

The present disclosure relates to packaging and methods of packaging consumer goods such as comestibles.

BACKGROUND

Consumer goods are often disposed in any of a variety of package types to organize, display, and protect products. Rigid packaging provides several advantages over other forms of packages such as increased protection of product housed within, improved reusability and durability, and strong potential for attractive branding and designs.

A common form of rigid packaging is a clamshell container, where two complementary container portions are coupled together at a hinge. As such, the container can be opened and closed to access and secure contents housed within. Sturdy construction and reliable opening and closing movements are desirable characteristics for clamshell containers.

Clamshell containers can be manufactured through various molding and casting processes, for example injection molding. However, a challenge that can occur when using molds to create clamshell containers is known in the packaging arts as a "thin steel condition," where the thinness of one or more portions of a given mold gives rise to several manufacturing issues with respect to warping, temperature management, maintenance difficulties, and poor lifespan of the mold. This is a particularly prominent issue with respect to molding hinge or coupling portions between container portions.

In addition, rigid clamshell containers are often bulky with relatively narrow branding surfaces that only provide limited visibility when presented among competing products on shelf and can be inconvenient for consumers to carry. As such, there is also a need for rigid containers with a stronger presence on shelf with broader branding space while being shaped for convenient transport by consumers.

SUMMARY

One embodiment relates to a container. The container includes a first shell portion and a second shell portion sized and shaped to complement the first shell portion to define a product cavity. The container further includes a bridging portion coupled to the first shell portion at a first hinge and the second shell portion at a second hinge, wherein the bridging portion is pivotable relative to each of the first shell portion at the first hinge and the second shell portion at the second hinge in a disassembled configuration and the bridging portion is pivotable relative to one of the first shell portion at the first hinge and the second shell portion at the second hinge in an assembled configuration.

Another embodiment relates to a method of manufacturing a container. The method includes providing a mold shaped to define a first shell portion, a second shell portion sized and shaped to complement the first shell portion to define a product cavity, and a bridging portion coupled to the first shell portion at a first hinge and the second shell portion at a second hinge, wherein the bridging portion is pivotable relative to each of the first shell portion at the first hinge and the second shell portion at the second hinge in a disassembled configuration and the bridging portion is pivotable relative to one of the first shell portion at the first hinge and the second shell portion at the second hinge in an assembled configuration. The method further includes forming the container using the mold. The method also includes coupling permanently the bridging portion to one of the first shell portion and the second shell portion.

It should be appreciated that all combinations of the foregoing concepts and additional concepts discussed in greater detail below (provided such concepts are not mutually inconsistent) are contemplated as being part of the inventive subject matter disclosed herein. All combinations of claimed subject matter appearing at the end of this disclosure are contemplated as being part of the inventive subject matter disclosed herein.

BRIEF DESCRIPTION OF THE DRAWINGS

A skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive rigid clamshell containers and methods of making such containers. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1B:
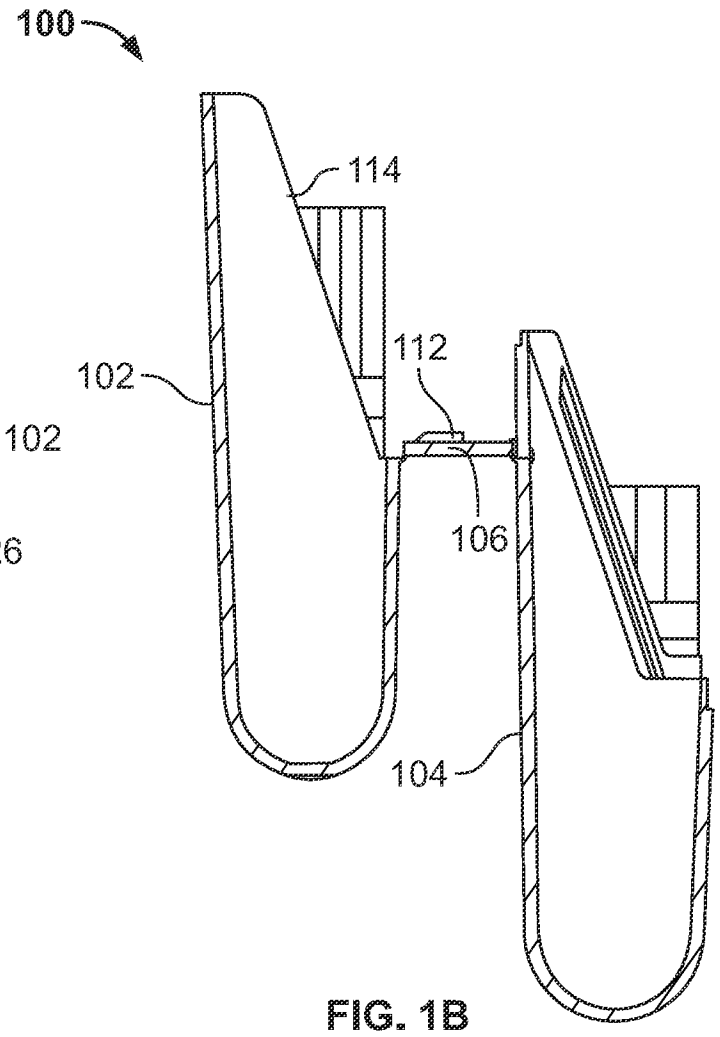
FIG. 1B is a left side view of the clamshell package of FIG. 1A in the unassembled, open configuration, according to an example embodiment.
Figure 1A:
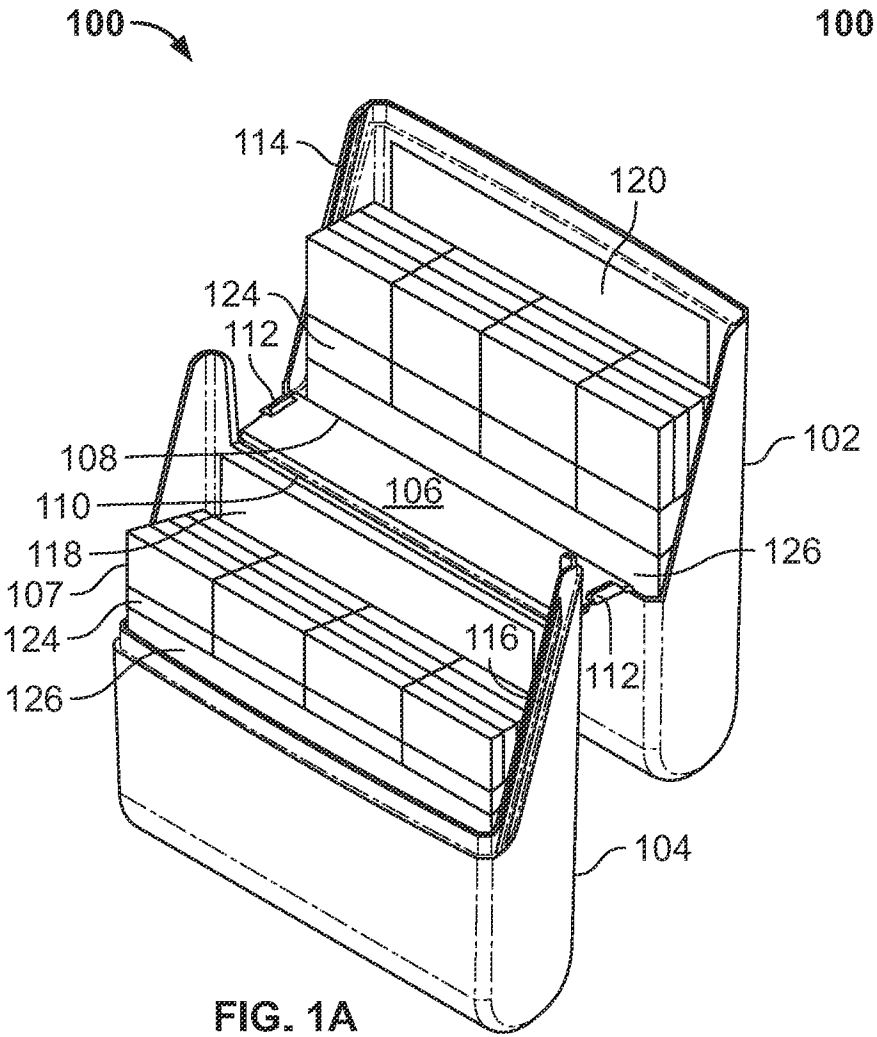
FIG. 1A is a perspective view of a clamshell package in an unassembled, open configuration, according to an example embodiment.

Referring to FIGS. 1A and 1B, a container 100 is shown in an open, unassembled configuration in accordance with example embodiments. In the arrangement shown, the container 100 is overall rectangularly shaped with rounded corners in a closed configuration, and openable to complementary halves in an open configuration. Other sizes and shapes of the container 100 are contemplated by and usable for the concepts provided in this disclosure, such as round shapes, oval shapes, square shapes, irregular, symmetrical, or asymmetrical shapes, and so on. In addition, as discussed below, the container 100 may or may not be disposed in equal sized halves in the open configuration. The container 100 may be used to house and protect consumer packaged goods such as food items, including but not limited to chewing gum. The container 100 may be made from any of a variety of materials used in the packaging arts, and in particular may be made of materials used in molding or casting processes that ultimately give rise to rigid packages, such as plastics, metals, or alloys or a combination thereof. In some arrangements, the container 100 is formed from materials derived from natural sources or may be made from biodegradable, compostable, recyclable, or otherwise sustainable materials.

The container 100 is configured as a clamshell and includes a first shell portion 102 configured to complementarily and releasably engage a second shell portion 104. Either or both of the first shell portion 102 and the second shell portion 104 may be formed such that the container 100 defines a product cavity that is sized and configured to fit a product 107 within the container 100 while in the closed configuration. In some arrangements, one shell portion may be formed as a lid while product 107 is primarily housed in the other shell portion. In other arrangements, each shell portion may be formed to house product 107, even when the container 100 is in the open configuration.

The product 107 may be any of a variety of items sold as consumer-packaged goods, as described above. In the arrangement shown, the product 107 is embodied as a plurality of chewing gum sticks in a side-by-side arrangement of gum stacks. In various arrangements, each stack of gum may be secured together by an article organizing member 124 such as a belly band, and in turn the stacks of gum may be further secured in the side-by-side arrangement by an article stack organizing member 126 such as a sheath, a larger belly band, and so on to attractively maintain the organization of gum sticks as individual gum sticks are removed. In some such arrangements, a given article organizing member 124 or the article stack organizing member 126 may be secured to the first shell portion 102 or the second shell portion 104, for example with adhesive, clips, tabs, and so on. This side-by-side arrangement of the product 107 provides the benefit of large surfaces for branding, designs, text, and other eye-catching visual features on the container 100 that significantly improves its presences on a display shelf. In addition, the side-by-side arrangement of product 107 provides a slim profile of the container 100 despite housing larger amounts of the product 107.

Figure 2:
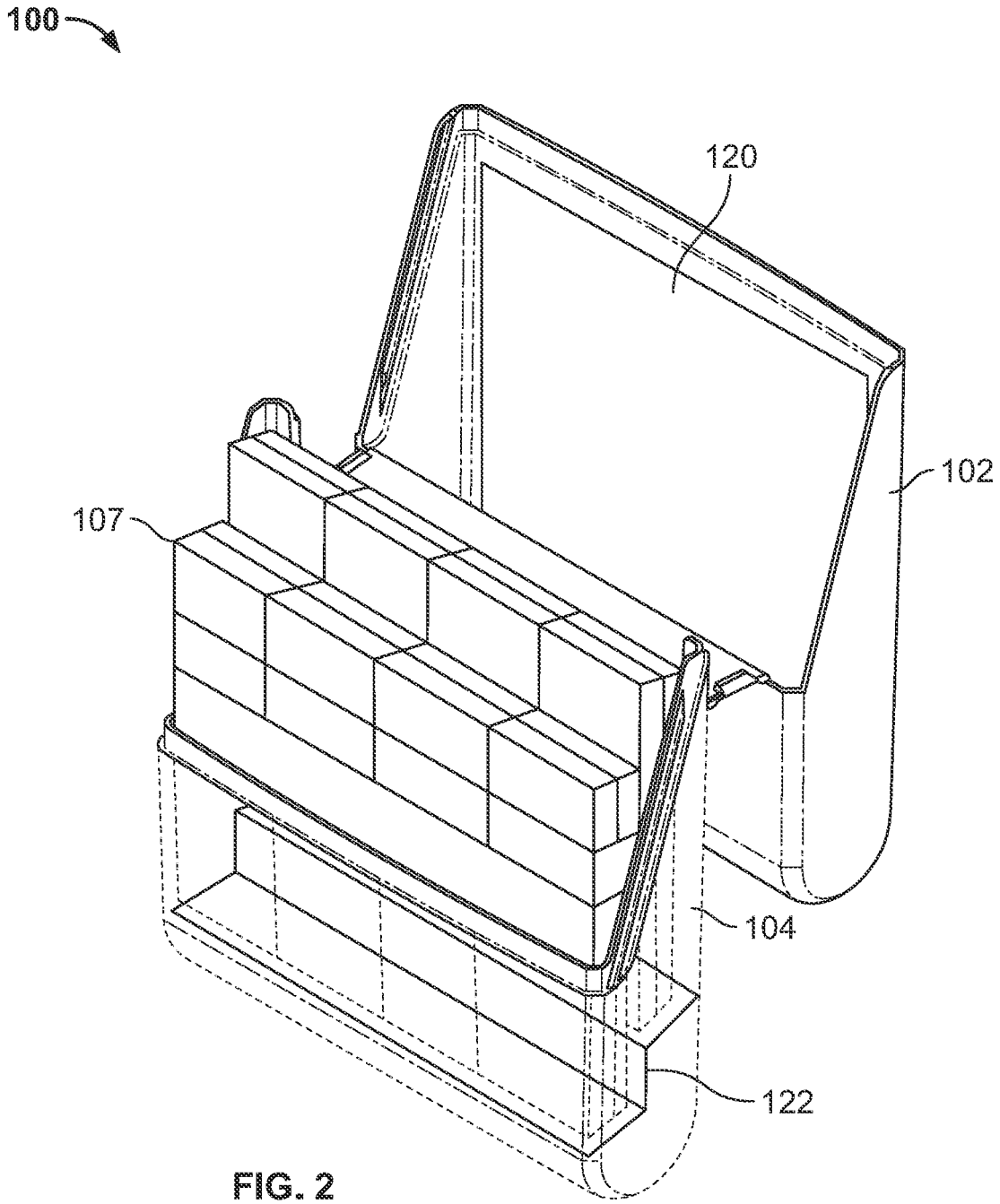
FIG. 2 is a perspective view of a clamshell package in an unassembled, open configuration with a second portion shown as transparent, according to an alternative embodiment.

In the arrangement shown, the product 107 is disposed in both the first shell portion 102 and the second shell portion 104 when the container 100 is in the open configuration. In some such arrangements, different types or varieties of the product 107 may be separately housed in the first shell portion 102 and the second shell portion 104, for example different flavors of comestible products may be arranged in each shell portion. However, in other arrangements, the product 107 may be disposed in either the first shell portion 102 only or the second shell portion 104 only when the container 100 is in the open configuration. In the arrangement shown in FIG. 2, the product 107 is housed in only the second shell portion 104 while the container 100 is in the open configuration, and further includes a stadium member 122 such as a shelf configured to stagger an arrangement the product 107, for example such that the product 107 is attractively displayed at different heights. In arrangements as that shown here where the product 107 is a plurality of articles, the stadium member 122 staggers the height of some of the articles relative to other articles such that multiple rows of the product 107 are shown at different heights. As one skilled in the art would appreciate, the stadium member 122 may be present in both shell portions 102, 104 in embodiments where the product 107 is disposed in both shell portions 102, 104.

Returning to FIGS. 1A and 1B, in some arrangements, the container 100 includes a securing member that releasably couples the first shell portion 102 and the second shell portion 104 together such that in a closed configuration product is safely housed in the product chamber, and in an open configuration the product is accessible to a user. Such features may be embodied as one or more undercuts, tabs and slots, ribs, interlocking protrusions, or other complementary components configured for releasable engagement. In the arrangement shown, the securing member is embodied as a first set of ribs 114 and a complementary second set of ribs 116 disposed on the first shell portion 102 and the second shell portion 104 respectively. In this arrangement, the first set of ribs 114 is disposed on internal faces of an internally facing recessed lip at the rim of either lateral side of the first shell portion 102, and the second set of ribs 116 is disposed on exterior faces of an exterior facing recessed lip at the rim of either lateral side of the second shell portion 104. The recessed lips on the shell portions 102, 104 are configured to complement and engage each other when the container 100 is in the closed configuration. In the arrangement shown, the ribs of the sets of ribs 114, 116 are disposed parallel to the rim of each respective shell portion 102, 104. In operation, as the container 100 is transitioned from the open configuration to the closed configuration, the first set of ribs 114 interlocks with the second set of ribs 116 as the first shell portion 102 engages the second shell portion 104, thereby releasably securing the container in the closed configuration. In some arrangements, the securing member is configured for audible engagement such as a pleasing "click" or other sound when the first shell portion 102 is secured to the second shell portion 104. For example, the first set of ribs 114 and the second set of ribs 116 may be configured to "click" when the ribs interlock in the closed configuration.

In some arrangements, the container 100 may include either or both of a first branding area 118 and a second branding area 120 disposed on interior faces (i.e., facing into the product cavity) of the first shell portion 102 or the second shell portion 104 respectively. The first branding area 118 and the second branding area 120 are portions of these interior faces upon which graphics, logos, decorations, slogans, or other visual components are disposed, for example as stickers, prints, dye, paint, embossed or debossed digits or designs, etched digits or designs, and so on. In some such arrangements like the arrangement shown in FIG. 1, at least a portion of the first branding area 118 and the second branding area 120 is visible even while the product 107 is disposed in the container 100. In other arrangements, either or both of the first branding area 118 and the second branding area 120 become visible as or after product 107 is removed from the container 100.

In some arrangements, the branding areas 118, 120 as well as the exterior faces of the container 100 may be used for any of a variety of highly customizable branding, personalization, or messaging purposes. Each of these areas and faces may be customized independently of any molding or casting processes used to make the container 100 itself, and as a result, the same stockpile of containers 100 may be used for different products, different brands, different varieties of product, and even for specific customers, by simply customizing the branding areas 118, 120 or exterior faces of each container 100. For example, in an embodiment, the exterior faces of a given container 100 present the logos, colors, and branding of a specific brand of chewing gum as determined by the chewing gum manufacturer, while the first branding area 118 and the second branding area 120 include images and text customized for a specific user. Any combination of such branding, personalization, and messaging across the exterior faces of the container 100 and the branding areas 118, 120 are contemplated by this disclosure.

In yet more arrangements, the container 100 may be formed such that it is entirely or partially transparent, so that one or more components inside are visible even when the container 100 is closed. As such, various components inside the container 100 may be used as branding surfaces. For example, in one such arrangement, the article stack organizing member 126 may include visual elements (e.g., any such elements that may be disposed on a branding area 118, 120) disposed on externally facing surfaces that would be visible through a transparent embodiment of the container 100. Visual elements may similarly be applied to the article organizing member 124 or individual wrappers of the product 107.

Figure 3B:
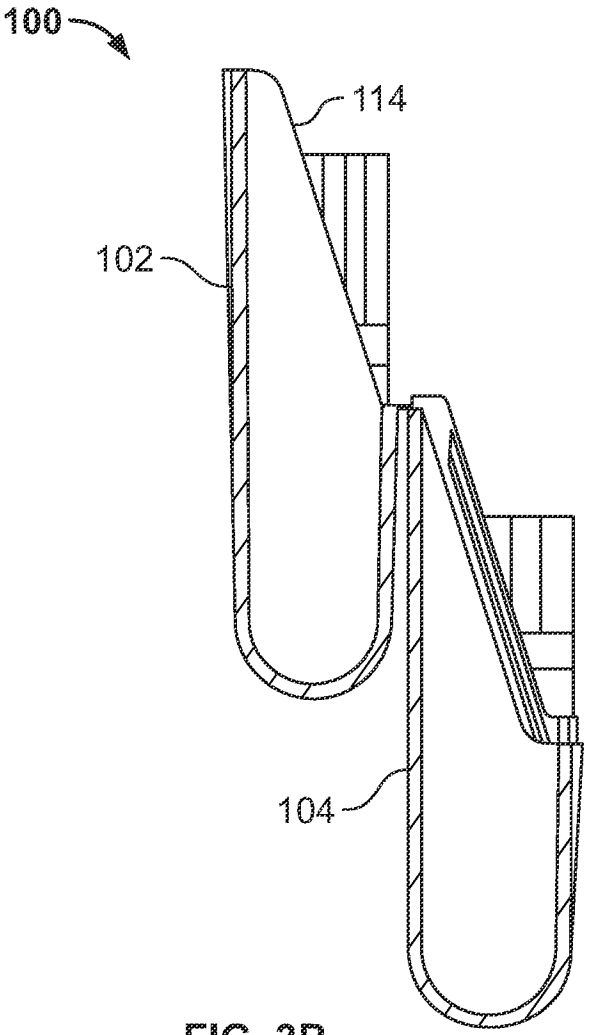
FIG. 3B is a left side view of the clamshell package of FIG. 3A in the assembled, open configuration, according to an example embodiment.
Figure 3A:
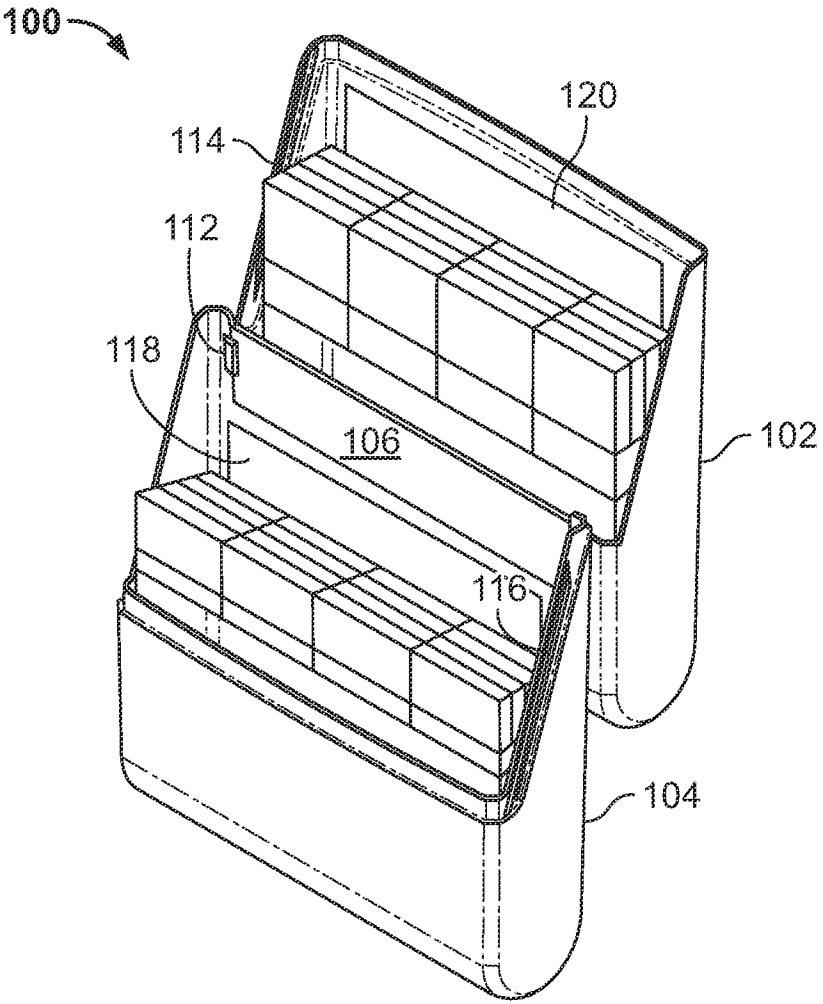
FIG. 3A is a perspective view of the clamshell package of FIG. 1A in an assembled, open configuration, according to an example embodiment.

A bridging portion 106 is disposed between the first shell portion 102 and the second shell portion 104. A first hinge 108 and a second hinge 110 couples opposing ends of the bridging portion 106 to the first shell portion 102 and the second shell portion 104 of the container respectively. Each hinge 108, 110 is a component capable of enabling a pivoting or hinging movement, such as a living hinge, a line of weakening, and so on. As a result, each of the first shell portion 102 and the second shell portion 104 can pivot relative to the bridging portion 106. The bridging portion 106 is sized and shaped to be received by either of the first shell portion 102 and the second shell portion 104 when the container 100 is in an assembled configuration (e.g., as shown in FIGS. 3A and 3B). In the arrangement shown in the figures, the bridging portion 106 spans less than the full width of the second shell portion 104, and the second shell portion 104 has a cutout sized and shaped to receive the bridging portion 106. In other arrangements, the bridging portion 106 may be received by either or both of the first shell portion 102 and the second shell portion 104.

As may be appreciated particularly in FIG. 1B, the bridging portion 106 effectively increases the distance between the first clamshell portion 102 and the second clamshell portion 104 when the container is molded in the unassembled configuration. As a result, a larger mold segment can be disposed between the first shell portion 102 and the second shell portion 104, thereby substantially reducing or eliminating thin steel conditions when the container is being manufactured.

Turning to FIGS. 3A and 3B, the container 100 is shown in an assembled, open configuration. The container 100 includes one or more fasteners 112 that permanently couple the bridging portion 106 to either of the first shell portion 102 or the second shell portion 104. The fasteners 112 couple the bridging portion 106 to the second shell portion 104 in the embodiment shown in FIGS. 3A and 3B. In contrast to the securing member, the coupling function of the fasteners 112 are not releasable, and as such, once the bridging portion 106 is coupled to one of the shell portions 102, 104, it cannot be readily uncoupled without a significant application of force or damaging the fasteners 112 or the corresponding shell or bridging portions 102, 104, 106. In various arrangements, the fasteners 112 may be embodied as one-way (i.e., irreversible) tabs or ribs, adhesives, welded or fused portions of the container, or other mechanical components intended for permanent engagement. As such, once the bridging portion 106 is coupled to a shell portion 102, 104, decoupling the bridging portion 106 would result in deforming tabs or ribs, or tearing adhesives or welds, and so on depending on the manner of fastener 112 used. In the arrangement of FIGS. 3A and 3B, the fasteners 112 are embodied as laterally protruding tabs on opposing sides of the bridging portion 106 that clip to the second shell portion 104 as the second shell portion 104 receives the bridging portion 106. In other arrangements using laterally protruding tabs, the fasteners 112 may be disposed on the first or second shell portion 102, 104 and clip onto the bridging portion 106.

Figure 4:
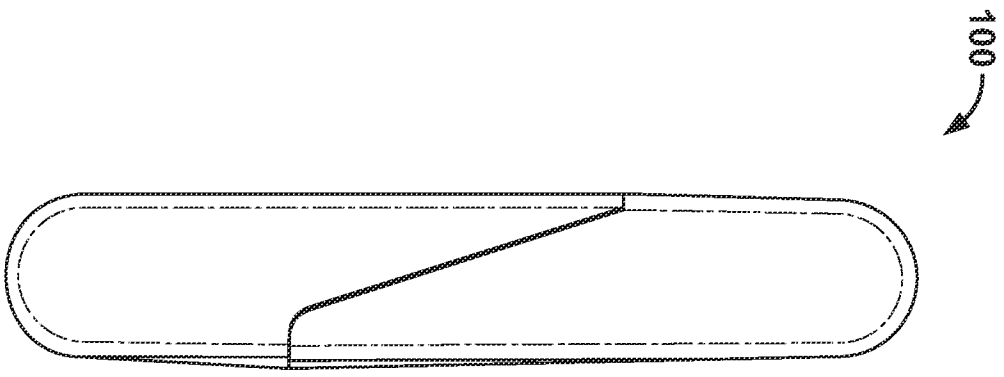
FIG. 4 is a left side view of the clamshell package of FIG. 1A in an assembled, closed configuration, according to an example embodiment.

The container 100 is shown in an assembled, closed configuration in FIG. 4. As a result of the bridging portion 106 being permanently coupled to the second shell portion 104, the first shell portion 102 can only pivot relative to the second shell portion 104 at the first hinge 108 to open and close the container 100. In arrangements where the bridging component 106 is instead permanently coupled to the first shell portion 102, the first shell portion can only pivot relative to the second shell portion 104 at the second hinge 110.

The advantage provided by taking the extra step of permanently coupling the bridging portion 106 to either of the first shell portion 102 and the second shell portion 104 after the container 100 is created is that the reduction or elimination of thin steel conditions in manufacturing is preserved while providing a single piece clamshell container (i.e., where the container is molded as a single piece not requiring the coupling together of separate pieces) with a strong, tightened pivoting action for opening and closing at a single hinge. In addition, the overall profile of the container 100 while in the open configuration is slimmer and more attractive, for example as shown in FIG. 3B. Maintaining a wider hinge for example by not permanently coupling the bridging portion 106 to one of the first shell portion 102 and second shell portion, or having a larger hinge altogether results in a weaker, flimsy hinge that disposes the first shell portion 102 at a greater distance from the second shell portion 104 when the container 100 is in the open configuration, for example as shown in FIG. 1B. As such, the costs of taking the additional step of permanently coupling the bridging portion 106 to a shell portion 102, 104 that renders one of the hinges 108, 110 inoperable are well justified by the advantages both in manufacturing and consumer use.

Figure 5:
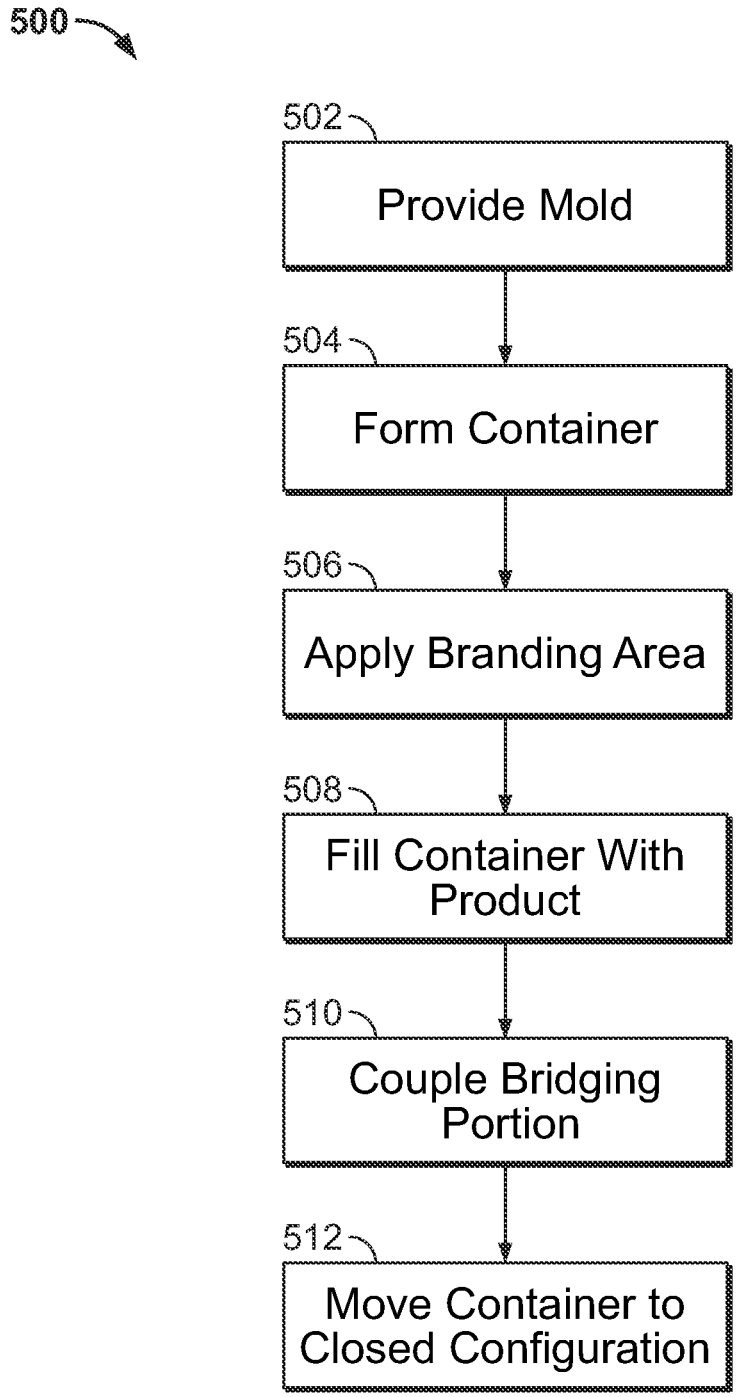
FIG. 5 illustrates a flow diagram showing a method of making a rigid clamshell container, according to an example embodiment.

In operation, an end user receives the container 100 housing product 107 in the closed configuration shown in FIG. 4. When the user wishes to access the product 107, the first shell portion 102 is urged away from the second shell portion 104, causing a pivoting action at the first hinge 108 when resistance provided by the interlocked first set of ribs 114 and second set of ribs 116 is overcome. The container 100 is then transitioned to the open configuration shown in FIG. 3, exposing the product 107 held within. The user selects one of the product 107 and observes the first branding area 118 and the second branding area 120 before returning the container 100 to the closed configuration as shown in FIG. 5. Throughout this operation, the bridging component 106 remains coupled to the second shell portion 104.

FIG. 5 illustrates a flow diagram showing a method 500 of making a clamshell container (e.g., container 100) containing consumer packaged goods (e.g., product 107) in accordance with example embodiments.

At 502, a container mold is provided. The container mold is shaped to define the container and includes a first shell portion (e.g., the first shell portion 102), a second shell portion (e.g., the second shell portion 104), and a bridging portion (e.g., the bridging portion 106). In various arrangements, the container mold may further define fasteners (e.g., fasteners 112), securing members (e.g., the first set of ribs 114 and the second set of ribs 116), stadium members (e.g., the stadium member 122).

At 504, a container (e.g., the container 100) is formed. The container is formed using the mold provided at 502 and may be made by any of various known processes such as injection molding or casting.

In some arrangements, branding areas (e.g., branding areas 118, 120) are applied to either or both of the first shell portion and the second shell portion of the container at 506. Branding areas may be applied by way of prints, dyes, stickers, or any of a variety of visual application methods.

At 508, the container is filled with product (e.g., the product 107). The product may be disposed at either or both of the first shell portion and the second shell portion of the container.

At 510, the bridging portion is coupled to either or both of the first shell portion and the second shell portion of the container. Fasteners (e.g., fasteners 112) are used to permanently couple the bridging portion to at least one of the first shell portion and the second shell portion of the container.

At 512, the container is moved to a closed configuration (e.g., as shown in FIG. 4). The first shell portion is pivoted at a hinge (e.g., the first hinge 108) of the bridging portion to releasably engage the second shell portion to arrive at the closed configuration. In some arrangements, additional graphics are disposed on exterior faces of the container (e.g., stickers, prints, dyes, etc.) and an overwrap is applied. Further, in some such arrangements, yet more graphics are applied on top of the overwrap (e.g., stickers, prints, etc.).

For the purpose of this disclosure, the term(s) "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The claims should not be read as limited to the described order or elements unless stated to that effect. Various changes in form and detail may be made by one of ordinary skill in the art without departing from the spirit and scope of the appended claims. All embodiments that come within the spirit and scope of the following claims and equivalents thereto are claimed.

The invention claimed is:

1. A container comprising:

a first shell portion;

a second shell portion sized and shaped to complement the first shell portion to define a product cavity;

a bridging portion coupled to the first shell portion at a first hinge and the second shell portion at a second hinge, wherein the bridging portion is pivotable relative to each of the first shell portion at the first hinge and the second shell portion at the second hinge in a disassembled configuration and the bridging portion is pivotable relative to only one of the first shell portion at the first hinge or the second shell portion at the second hinge in an assembled configuration; and a fastener coupled to the bridging portion and to one of the first shell portion or the second shell portion in the assembled configuration, wherein the fastener prevents the bridging portion from pivoting relative to the one of the first shell portion or the second shell portion in the assembled configuration.

2. The container of claim 1 wherein one of the first shell portion or the second shell portion is sized and shaped to house a product when the container is in an open configuration.

3. The container of claim 1 wherein each of the first shell portion and the second shell portion is sized and shaped to house a product when the container is in an open configuration.

4. The container of claim 1, further comprising a product comprising a plurality of articles and at least one stadium member shaped to stagger an arrangement of the plurality of articles in the container.

5. The container of claim 1, further comprising a product comprising a plurality of articles wherein the plurality of articles is organized as a side-by-side arrangement of stacks.

6. The container of claim 5 wherein the product is coupled to the container.

7. The container of claim 1, further comprising at least one securing member releasably coupling the first shell portion to the second shell portion in a closed configuration.

8. The container of claim 7 wherein the at least one securing member is configured for audible engagement.

9. The container of claim 1 wherein an interior face of at least one of the first shell portion or the second shell portion comprises a branding area.

10. A method of manufacturing a container, the method comprising:

providing a mold shaped to define:

a first shell portion;

a second shell portion sized and shaped to complement the first shell portion to define a product cavity;

a bridging portion coupled to the first shell portion at a first hinge and the second shell portion at a second hinge, wherein the bridging portion is pivotable relative to each of the first shell portion at the first hinge and the second shell portion at the second hinge in a disassembled configuration and the bridging portion is pivotable relative to only one of the first shell portion at the first hinge or the second shell portion at the second hinge in an assembled configuration; and a fastener coupled to the bridging portion and to one of the first shell portion or the second shell portion in the assembled configuration, wherein the fastener prevents the bridging portion from pivoting relative to the one of the first shell portion or the second shell portion in the assembled configuration;

forming the container using the mold; and coupling permanently the bridging portion to one of the first shell portion or the second shell portion.

11. The method of claim 10 wherein one of the first shell portion or the second shell portion is sized and shaped to house a product when the container is in an open configuration.

12. The method of claim 10 wherein each of the first shell portion and the second shell portion is sized and shaped to house a product when the container is in an open configuration.

13. The method of claim 10 wherein the mold is further shaped to define at least one stadium member shaped to stagger an arrangement of a plurality of articles in the container.

14. The method of claim 10 wherein the mold is further shaped to define at least one securing member releasably coupling the first shell portion to the second shell portion in a closed configuration.

15. The method of claim 14 wherein the at least one securing member is configured for audible engagement.

16. The method of claim 10, further comprising applying a branding area to an interior face of at least one of the first shell portion or the second shell portion.

17. The method of claim 10, further comprising filling at least one of the first shell portion or the second shell portion with a product comprising a plurality of articles.

18. A container comprising:

a first shell portion;

a second shell portion sized and shaped to complement the first shell portion to define a product cavity;

a bridging portion coupled to the first shell portion at a first hinge and the second shell portion at a second hinge, wherein the bridging portion is pivotable relative to each of the first shell portion at the first hinge and the second shell portion at the second hinge in a disassembled configuration and the bridging portion is pivotable relative to one of the first shell portion at the first hinge or the second shell portion at the second hinge in an assembled configuration, wherein a distance between the first shell portion and the second shell portion is greater in the disassembled configuration than in the assembled configuration; and a fastener coupled to the bridging portion and to one of the first shell portion or the second shell portion in the assembled configuration, wherein the fastener prevents the bridging portion from pivoting relative to the one of the first shell portion or the second shell portion in the assembled configuration.

19. The container of claim 5 wherein each article of the plurality articles is secured by an article organizing member, wherein the plurality of articles are secured by an article stack organizing member.

20. The container of claim 19, wherein the article organizing member comprises a belly band, wherein the article stack organizing member comprises a sheath.

* * * * *